United States Patent [19]

Begon

[11] Patent Number: 4,817,942

[45] Date of Patent: Apr. 4, 1989

[54] SAFETY FENCING SWORD

[75] Inventor: Jean A. Begon, Saint-Etienne, France

[73] Assignee: Begon S.A. Societe Anonyme, Le Chambon Feugerolles, France

[21] Appl. No.: 10,978

[22] PCT Filed: May 7, 1986

[86] PCT No.: PCT/FR86/00160

§ 371 Date: Jan. 9, 1987

§ 102(e) Date: Jan. 9, 1987

[87] PCT Pub. No.: WO86/06824

PCT Pub. Date: Nov. 20, 1986

[30] Foreign Application Priority Data

May 10, 1985 [FR] France ..... 85 07459

[51] Int. Cl.[4] ..... A63B 69/02

[52] U.S. Cl. ..... 272/98; 273/1 F

[58] Field of Search ..... 272/98, 93; 30/349, 30/351, 353, 357; 273/1 F

[56] References Cited

U.S. PATENT DOCUMENTS 2,338,007 12/1943 Morris ..... 30/351

FOREIGN PATENT DOCUMENTS

| | | | |
|---|---|---|---|
| 393476 | 12/1908 | France | 30/353 |
| 439666 | 6/1912 | France . | |
| 1363602 | 5/1964 | France | 273/1 F |
| 34206 | 12/1964 | German Democratic Rep. | 273/1 F |
| 1473751 | 5/1977 | United Kingdom | 272/98 |
| 2129315 | 5/1984 | United Kingdom | 272/98 |

*Primary Examiner*—V. Millin
*Assistant Examiner*—S. R. Crow
*Attorney, Agent, or Firm*—Herbert Dubno

[57] ABSTRACT

A fencing sword, especially an epee or a foil, whose blade is provided with at least one groove defining a strain concentration zone, dimensioned to rupture longitudinally to separate two longitudinal parts of the blade from one another so that, with subsequent impacts, there is a change in the nature of the sound generated by impact. The rupture occurs when the metal fatigue reaches a point at which transverse rupture might be expected so that the sound change can inform the user of the need to discard the blade.

10 Claims, 3 Drawing Sheets

VIII
16
14
10
12
13
15
X
XI
XII
XIII
18
17
20
L
10a
22
D2
K
18a
p2
e2
T2
D1
p1
e1
T1

SAFETY FENCING SWORD

CROSS REFERENCE TO RELATED APPLICATIONS

This application is a national phase application corresponding to PCT/FR86/00160 filed May, 7, 1986 and based, in turn, on French national application No. 85.07459 filed May, 10, 1985 under the International Conventional.

FIELD OF THE INVENTION

My present invention relates to a safety fencing sword, and more particularly, to a fencing sword capable of signalling to the fencer of metal fatigue condition resulting from use of the sword which can be associated with a transverse rupture of the blade.

BACKGROUND OF THE INVENTION

Traditionally fencing swords, namely foils, epees and sabers are made of treated, alloyed or carbon steel.

Under repeated impact, through mutual contact between the two blades, but also due to the intense strains to which the blades may be subjected, the metal the blades are made from becomes hard and brittle and eventually breaks. When a transverse rupture occurs during an attack, the blade portion still in the hand of the fencer, with its end sectioned off and generally bevel-edged, becomes a dreadful weapon, capable of penetrating the protective garment and the body of the component, with the risk of killing him. To remedy this, it has been considered to make the blade of an age-hardening steel, incorporating nickel and titanium, with or without the addition of molybdenum and cobalt. Experience shows these blades to be more durable, but under certain conditions of severe use, the blade may still break transversely just like blades of the common alloyed steels. It seems therefore that the age-hardening steels delay the problem, but do not completely solve it.

OBJECT OF THE INVENTION

It is the object of the present invention to remedy this inconvenience, by creating a safety sword able signal the moment when the blade may be affected by a risk of breakage and has to be discarded.

SUMMARY OF THE INVENTION

For this purpose, the blade according to the invention comprises at least on a portion of its length extending from its free end, a longitudinal area of reduced cross section, concentrating therein the strains to which of the blade subjected and which, when the material the blade is starts to manifest a fatigue which is liable to result in its transverse rupture, is capable of longitudinally dividing into longitudinal fragments, thus indicating the state of fatigue of the metal.

Thus, when the metal constituting the blade reaches a state of fatigue capable of inducing transverse breakage, the strains to which the blade is subjected during a match bring about the break of the strain concentration zone, at least on one portion of the length of the blade. The longitudinal crack created thereby changes the physical characteristics of the blade, which results in a different sound at impact. These modifications in the physical and acoustic characteristics alert the two fighters that they a rupture interrupt their match in order to replace the defective sword, thus preventing any body injury.

The particular construction of the blade of the invention allows for the substitution of a longitudinal split in the blade for the extremely dangerous transverse rupture, without danger to the fencers.

In the case of a foil, the longitudinal breaking zone comprises an axial web which is defined by two deep, longitudinal grooves, opening from the small faces of the blade, conferring to this zone an "H"-shaped section, and the thickness of the web, in cross section, increases proportionally with the increase in the blade cross section, from the extremity of the blade to the end of the breaking zone.

With this design, the sword is lighter and all the strains thereon during a match, are distributed over the web and over its length. In addition, the cracks occurring in the wings of the H-cross section of the blade, as a consequence of metallographic structural transformations in the metal during attacks and impact-related, are confined to the strain concentration zone and cause a transverse rupture of the blade only over half of its thickness.

For an epee having an approximately "V"-shaped cross section, the longitudinal breaking zone is arranged on the back rib, between the exterior face of this rib and the bottom of a longitudinal groove opening into the concavity of the "V"-section, and increasing in cross section proportionally with the increase in the cross section of the blade, from its extremity to the end of the breaking zone.

BRIEF DESCRIPTION OF THE DRAWING

The invention will be better understood with the aid of the following description, reference being made to the accompanying schematic drawing, representing examples of embodiments of a foil and of an epee, according to the invention. In the drawing.

SPECIFIC DESCRIPTION

In FIGS. 1 to 6, a foil blade 2 has a tip extended with a threaded stud 3 and a base extended with a threaded rod 4, for mounting a handle. This blade has a cross section of a generally rectangular shape.

Figure 3:
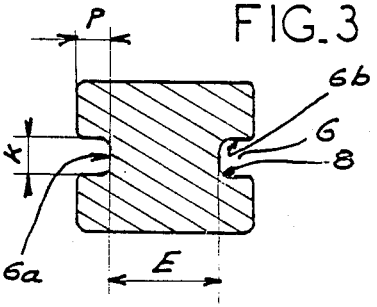
FIGS. 3, 4 and 5 are sectional views along the line III—III, IV—IV, V—V of FIG. 2, representing, on a larger scale, partial sections of the blade.
Figure 4:
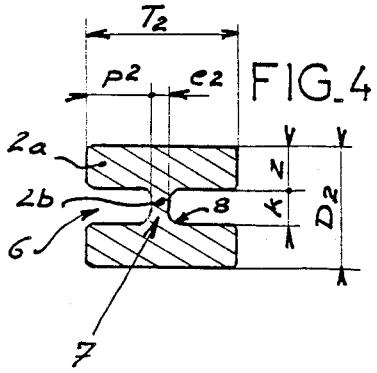
Figure 5:
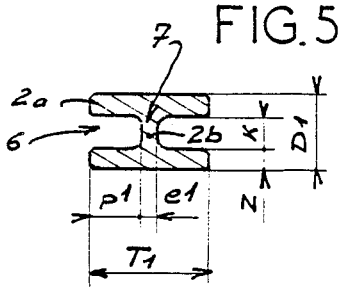

According to the invention, this blade is formed with two longitudinal, deep grooves 6, starting from its two small faces and giving an H-shaped cross section, formed by two wings or flanges 2*a* connected by a web 2*b*. More precisely, the two parallel bottoms 6*a* of the grooves 6 define between them in the breaking area 7, a strain concentration zone, corresponding to the web 2*b* of the H-shaped cross section. Each of the bottoms 6*a* is joined with the corresponding lateral faces 6*b*, with corner roundings or fillets 8. As shown in FIGS. 3 to 5, for the length "l" which controls the breakage starting from its extremity to approximately half of its length, the grooves have a depth $p_1$ to $p_2$, which keeps increasing approximately proportional with the increase of the dimensions T1 to D1, T2 to D2 of the blade cross-section, so that the web 2*b* has in the zone 7 a thickness e1 to e2, increasing also proportionally with the increase of the cross section, in order to provide a constant resistance over this length. Beyond this length, as shown in FIG. 3, the grooves have a constant depth P and the thickness E of the web 2*b* keeps increasing until it reaches the base.

When this blade is used, the repeated shocks and alternate compression and extension strains affecting the wings of the "H"-shape are transmitted over the entire length of the web 2*b*. As a result, any metal fatigue affects first the zone 7, which due to its reduced thickness is the first one to yield. The break does not occur transversally, as in the case of traditional swords, but longitudinally on at least one portion of the length of the blade and is characterized by a longitudinal crack separating the two wings of the H-shaped cross section. This break affects the resistance of the elasticity of the blade and also changes the sound the blade makes on impact, thus providing and indication for the need to replace the blade.

These grooves define therefore a longitudinal zone 7 which by concentrating the strains not only anticipates the dangerous transverse breaking of the blade, but also changes the preferred direction of rupture to a longitudinal one and informs the user that his blade has to be discarded.

Figure 1:
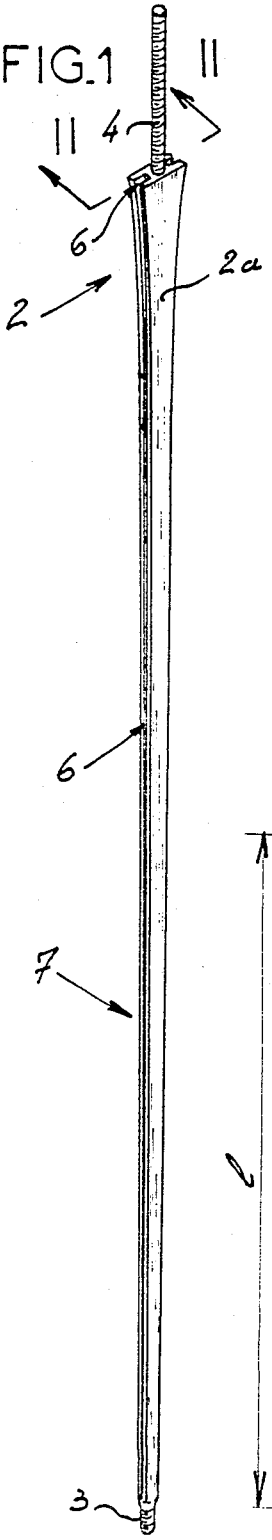
FIG. 1 is a perspective view of a foil.
Figure 2:
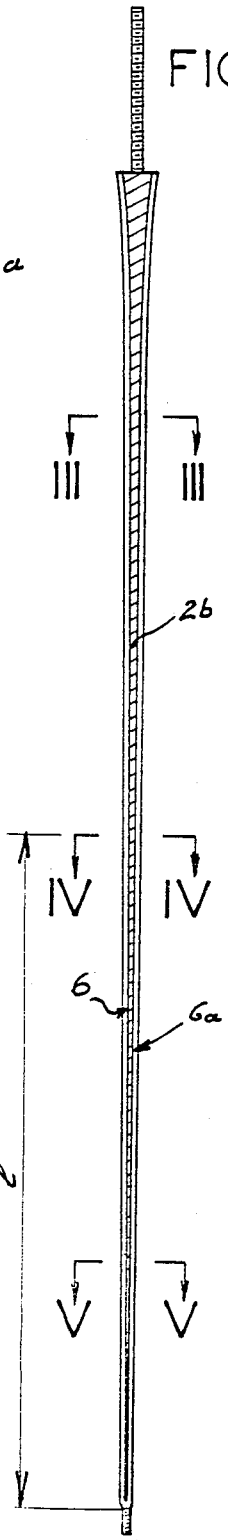
FIG. 2 is a view in longitudinal section taken along the line II—II of FIG. 1.
Figure 6:
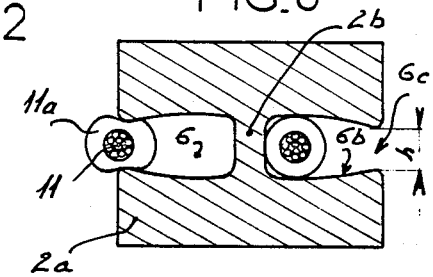
FIG. 6 is a view in transverse section similar to FIG. 4 of another embodiment.

In the embodiment represented in FIG. 6, the grooves 6 are provided with lateral faces or flanks 6*b*, convergently angled towards the outside, resulting in a trapezoidal cross section whose small base is the opening 6*c* the blade forming the mouth of the groove. The opening 6*c* has a height h smaller than the diameter of the jacket 11*a* of the wire 11 which is to be arranged in the groove 6 for transmitting the touches with electrical foil of the opponent's protective garment in matches.

As shown in the left side of FIG. 6, the mounting of the wire in its location in the corresponding groove 6 is performed by applying a pressure on its sheath 11*a* towards the bottom of the groove, so that the sheath 11*a* is elastically deformed while passing through the opening 6*c*. When the conductor is located within the groove 6, its outer sheath resumes its initial dimensions, due to its own elasticity. As shown on the right side of the same figure, the sheath 11*a* cooperates with the angled faces 6*b* of the groove, which insures that the conductor stays within the groove without glueing.

Because of this arrangement the conductor 11 is kept perfectly within the groove and can not exit therefrom, even when the blade is subjected to considerable flexure. During such flexure, the conductor in its insulating coating can slide within the groove 6, without disturbing its position within the groove or the functioning of the wire.

Finally, this way of keeping the conductor in place within the groove considerably facilitates its replacement, because it is no longer necessary to perform delicate operations, such as to unglue the defective conductor with the aid of solvents and to glue a new conductor in the groove. The groove with a trapezoidal cross section can be provided only on one side of the foil.

The epee 10 shown in FIGS. 7 to 13 has a "V"-shaped cross section, defining an outer rib 12, running from the tip 13 to the base 14. The tip is provided with a threaded stud 15, while the heel is extended with a threaded rod 16.

Figures 7, 8, 9, 10, 11, 12, 13:
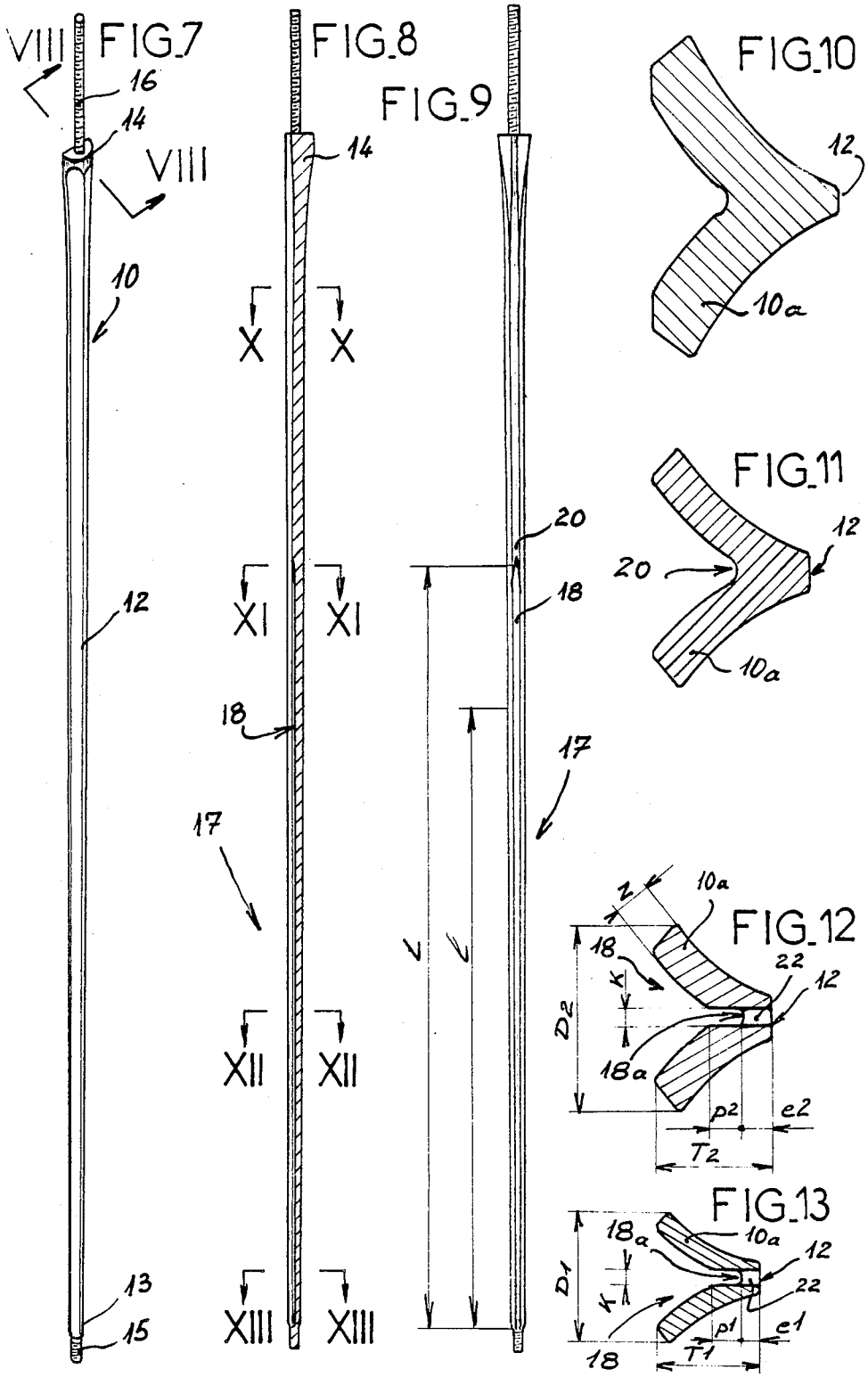
FIG. 7 is a perspective view of the blade of an epee.
FIG. 8 is a longitudinal section along the line VIII—VIII of FIG. 7.
FIG. 9 is an elevational view into the hollow of the blade of FIG. 7.
FIGS. 10, 11, 12 and 13 are transverse sectional views along lines X—X, XI—XI, XII—XII, XIII—XIII of FIG. 8, showing transversal sections of this blade on a larger scale.

According to the invention, this epee also has on a portion of its length for instance on half of its length as represented by the sgement 1, starting from the extremity of the epee, a longitudinal zone 17 for strain concentration and for longitudinal breaking. This zone is arranged in the back rib between the outer face 12 constituting this rib and the bottom 18*a* of a groove 18 originating from the concavity of "V"-shaped cross section of the epee. On the length portion 1 of the blade, the depth P1 to P2 of the groove 18 increases, as in FIGS. 12 and 13, from the tip 13 of the blade and proportionally with the variations of the dimensions T1 and D1 of the cross section of the blade. The longitudinal breaking zone 17 has a thickness e1 to e2, which keeps increasing from the tip of the blade to the end of the longitudinal breaking zone 7. From that point on and continuing towards the base 14, the depth of the groove 18 decreases, reaching a point where the bottom 18*a* of the groove is flush with the bottom 20 of the blade profile as shown in FIG. 10. The area where this leveling occurs, is situated at a distance L from the extremity of the blade exceeding the distance 1.

With this arrangement, when the metal constituting the blade reaches the point of breaking due to fatigue, the break takes place in the area of strain concentration 17, in the form of a crack separating the two wings of the "V"-shaped cross section. As in the case of foils, this breakage induces a modification of the elastic characteristics of the blade and of the sounds it makes on impact, warning the user that the match must be stopped and the blade discarded.

The thickness of the longitudinal breaking zone 17 of the epee can also be controlled by machining the face 12 with or without machining of the groove 18.

It has also to be noted that the thickness e1 to e2 of the strain concentration zone 17 of the epee, as well as the thickness e1 to e2 of the strain concentration zone 7 of the foil 2, is smaller than the thickness z of either one of the wings 10*a*–2*a* connected by them, in a manner as to ensure the formation of a breaking zone.

The groove 6–18, which makes possible the mastering of all geometric characteristics of the strain concentration zone, can be formed in any of the materials the blades can be made from. But its manufacture is simpler, less expensive and faster in the case of blades made of age-hardening alloys, while such blades are in a tempering stage where the material has a high plasticity and a low hardness; after the formation of the grooves 6 and the rest of the machining is concluded, the blade is hardened by raising the temperature.

Figure 14:
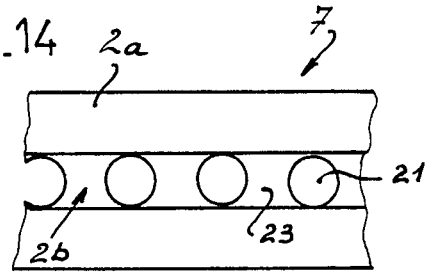
FIGS. 14 and 15 are fragmentary side elevational views on a larger scale, of the blade of a foil in two embodiments of the breaking zone.
Figure 15:
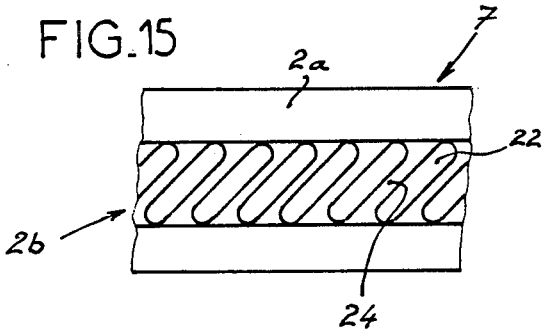

In embodiments shown in FIGS. 14 and 15, the web of the foil 2 is crossed, in the area of its longitudinal breaking zone 7, by openings. These openings of circular shape as shown at 21 in FIG. 14, or of oblong shape, as shown at 22 in FIG. 15, are distributed according to a regular or irregular pitch. They define bridges of material, respectively 23–24 which increase the strain concentration and constitute rupture indicators. The oblong openings 22 are inclined by 30°–60° with respect to the longitudinal axis of the foil, and are separated by a small pitch, so that the anterior extremity of each opening is located beyond the posterior extremity of the preceding opening or at least at the same level therewith. In an embodiment not shown here, they can also be located in any manner on both sides of the longitudinal axis of the blade, holding parallel to this axis. The transverse size of each opening is less than 1 mm and of the order of a few tenth of a millimeter. As shown also in FIGS. 12 and 13, such perforations 21 or 22 can also be provided in the longitudinal rupture zone of the epee, with or without groove 18.

In the preceding embodiments it has been indicated that the longitudinal breaking zone extends over one half of the length of the blade, but it is obvious that this size is given only as an example, and that it can also range between one third and two thirds of the length, or even more. The length of breaking zone can vary depending on the characteristics of the material of the blade which can be steel, a forged alloy, but also a composite material.

I claim:

1. A safety fencing sword capable of providing an audible indication of metal fatigue, comprising:

an elongated blade having a tip at one end and means for mounting a handle at an opposite end of the blade; and at least one groove formed in said blade and subdividing same over at least a portion of the length of said blade from said tip into at least two elongated blade parts held together by a strain concentration zone fixedly and unitarily interconnecting said parts for effective fencing, said strain concentration zone being dimensioned and configured to rupture longitudinally upon the development of a fencing-use-generated fatigue of the material approaching a transverse-breakage condition to cause exclusive longitudinal separation of said parts at said portion of said blade, thereby altering a sound generated by the blade upon impact.

2. The safety fencing sword defined in claim 1 wherein said blade is the blade of a foil which is formed with said portion with two longitudinally extending grooves extending into said blade from opposite sides and defining between them a web constituting said strain concentration zone, said grooves forming said blade into an H cross section, said web increasing in thickness proportionately to an increase in said cross section over the length of said portion from said tip.

3. The safety fencing sword defined in claim 2 wherein at least one of said grooves has a narrow portion at a mouth thereof and is defined by a pair of flanks converging toward said mouth, an electrical conductor being lodged in said one of said grooves and being held in place by said narrow portion.

4. The safety fencing sword defined in claim 2 wherein said grooves have mutually parallel bottoms adjoining flanges defined by said grooves in said portion of said blade by respective rounded fillets.

5. The safety fencing sword defined in claim 1 wherein said blade is the blade of an epee having a generally V-shaped cross section and provided with a rib substantially at the vertex of the V, said rib forming said strain concentration zone with a rounded bottom of said groove, said strain concentration zone increasing in thickness proportionately with an increase in thickness of the cross section of said blade to said tip.

6. The safety fencing sword defined in claim 1 wherein said zone has a thickness at any cross section of said blade along said portion which is less than the thickness of said parts interconnected by said zone.

7. The safety fencing sword defined in claim 1 wherein said zone is formed with throughgoing openings spaced apart along said portion.

8. The safety fencing sword defined in claim 7 wherein said openings are circular.

9. The safety fencing sword defined in claim 7 wherein said openings are elongated.

10. The safety fencing sword defined in claim 9 wherein said openings are inclined to a longitudinal dimension of said blade and overlap therealong transversely.

* * * * *